US011599062B2

(12) United States Patent
Hernandez et al.

(10) Patent No.: US 11,599,062 B2
(45) Date of Patent: Mar. 7, 2023

(54) TIMEPIECE BALANCE

(71) Applicant: Nivarox-FAR S.A., Le Locle (CH)

(72) Inventors: Ivan Hernandez, Cressier (CH); Pierre Cusin, Villars-Burquin (CH)

(73) Assignee: Nivarox-FAR S.A., Le Cocle (CH)

( * ) Notice: Subject to any disclaimer, the term of this patent is extended or adjusted under 35 U.S.C. 154(b) by 202 days.

(21) Appl. No.: 17/116,367

(22) Filed: Dec. 9, 2020

(65) Prior Publication Data

US 2021/0191328 A1 Jun. 24, 2021

(30) Foreign Application Priority Data

Dec. 18, 2019 (EP) ..... 19217681

(51) Int. Cl.
*G04B 17/06* (2006.01)

(52) U.S. Cl.
CPC ..... *G04B 17/063* (2013.01)

(58) Field of Classification Search
CPC ..... G04B 17/06; G04B 18/00; G04B 17/20; G04B 17/063
See application file for complete search history.

(56) References Cited

U.S. PATENT DOCUMENTS 455,787 A * 7/1891 Bilgram ..... G04B 17/222 368/171
1,023,140 A * 4/1912 Ecaubert ..... G04B 17/24 368/170
D730,764 S * 6/2015 Graf ..... D10/128
9,547,278 B2 * 1/2017 Graf ..... G04B 18/006
10,061,269 B2 * 8/2018 Graf ..... G04B 18/06
2016/0062314 A1 * 3/2016 Graf ..... G04B 17/20 368/171
2017/0168456 A1 * 6/2017 Christan ..... G04D 1/04

FOREIGN PATENT DOCUMENTS

| | | | |
|---|---|---|---|
| CH | 227 189 | A | 5/1943 |
| CH | 343 904 | A | 12/1959 |
| CH | 705 238 | A2 | 1/2013 |
| CN | 206178347 | U | 5/2017 |
| FR | 3 043 801 | A3 | 5/2017 |

OTHER PUBLICATIONS

European Search Report 19 21 7681 dated Jun. 9, 2020.
Communication dated Nov. 12, 2021 from the China National Intellectual Property Administration in Chinese Application No. 202011502827.4.

* cited by examiner

*Primary Examiner* — Sean Kayes
(74) *Attorney, Agent, or Firm* — Sughrue Mion, PLLC

(57) ABSTRACT

A balance for a horological movement, including rigid parts including a hub defining the pivot axis of the balance, a felloe sector, at least one arm connecting the felloe sector to the hub, and including a slot for receiving and gripping an inertia-block in position, the slot opening into a housing delimited on the one hand by a rigid part of the balance, and on the other hand an elastic arm including a first end integral with a rigid part of the balance, and a second free distal end. The elastic arm has a hook-shaped body, the free distal end of the hook being parallel to a part of the balance having a rigidity greater than or equal to that of the elastic arm.

15 Claims, 3 Drawing Sheets

TIMEPIECE BALANCE

CROSS-REFERENCE TO RELATED APPLICATIONS

This application claims priority to European Patent Application No. 19217681.6 filed Dec. 18, 2019, the entire contents of which are incorporated herein by reference.

FIELD OF THE INVENTION

The invention relates to a balance for a horological movement, including rigid parts consisting of a hub defining the pivot axis of the balance, a felloe, and at least one arm connecting the felloe to the hub, and including at least one retaining organ for receiving and gripping a rod of an inertia-block in position.

The invention relates to the field of horological oscillators, and more particularly to the field of balances including means for adjusting inertia and/or balancing.

BACKGROUND OF THE INVENTION

Numerous embodiments of balances are known with means for adjusting inertia and/or balancing. In particular, balances with inertia-blocks which are screwed or driven into implantations of the felloe of a balance are known. Some achievements have attempted to retain the inertia-block by gripping. Document CH 705 238 is thus known which discloses a balance including at least one slot for receiving and gripping a rod of an inertia-block in position, the slot being delimited by, on the one hand, one said rigid part of the balance, and on the other hand an elastic arm permanently returned towards said rigid part of said balance delimiting said slot to retain the inertia-block.

When inserting the inertia-blocks, the elastic arm undergoes significant plastic deformations due to its spreading. These plastic deformations can then cause defects in the material, such as cracks. This can therefore adversely affect the reliability of the balance, or even damage it, since the inertia-block can no longer be retained correctly by the elastic arm and become dislodged.

SUMMARY OF THE INVENTION

The purpose of the invention is in particular to overcome the various disadvantages of these known techniques.

More specifically, a purpose of the invention is to provide a balance allowing to obtain better retention of the inertia-blocks with an elastic arm capable of remaining in stress levels not exceeding its elastic limit and thus minimising the risk of defects.

Another purpose of the invention is to provide a balance with an elastic arm having a sufficiently rigid geometry and allowing a sufficient bearing force to allow the inertia-block to be retained in place regardless of the type of shock undergone by the watch.

These purposes, as well as others which will emerge more clearly below, are achieved according to the invention by means of a balance for a horological movement according to claim 1.

In accordance with other advantageous variants of the invention:

- the free distal end of the elastic arm has a flat section, the flat section being disposed opposite the part of the balance having a rigidity greater than or equal to that of the elastic arm;

- the elastic arm comprises an inner surface of constant curvature over an angle $\alpha$, at the centre of the circle having a centre C, greater than 240°,
- the elastic arm comprises a constant section over an angle $\beta$, at the centre of the circle having a centre C, greater than 150°,
- the flat section extends over an angle $\gamma$, at the centre of the circle having a centre C, comprised between 20° and 50°;
- the slot extends parallel to a radial from said pivot axis;
- the elastic arm is shaped to remain under a plastic deformation threshold of 0.3% at the bottom of the housing during a substantially vertical rise of the elastic arm relative to the rigid part of the balance to place the rod of the inertia-block;
- the housing is circular in shape with an inlet defined by the slot and a bottom, the bottom of the housing having dimensions greater than the inlet of the housing;
- the elastic arm provides a retaining force of at least 0.7 N;
- the rigid part comprises a notch for positioning the inertia-block, the width of the opening being less than the diameter of the rod of the inertia-block;
- the elastic arm is integral with the felloe;
- the elastic arm is integral with the hub;
- the at least one elastic arm is made in one piece with the balance;
- the balance comprises several elastic arms, the elastic arms being disposed in a central symmetry having as centre that of the balance.

The invention also relates to a horological movement comprising a balance-spring oscillator system in accordance with the invention.

The invention also relates to a timepiece comprising a horological movement in accordance with the invention.

The invention also relates to a method for mounting an inertia-block on a balance in accordance with the invention.

Thus, the object of the present invention, by its various functional and structural aspects described above, allows to obtain a more robust balance, in particular thanks to the disappearance of tensile stress on the surface along the inner surface of the elastic arm, this allowing to limit the formation of weakened areas.

BRIEF DESCRIPTION OF THE DRAWINGS

Other features and advantages of the invention will emerge more clearly upon reading the following description of a particular embodiment of the invention, given by way of simple illustrative and non-limiting example, and the appended figures, among which.

DETAILED DESCRIPTION OF PREFERRED EMBODIMENTS

Figure 1:
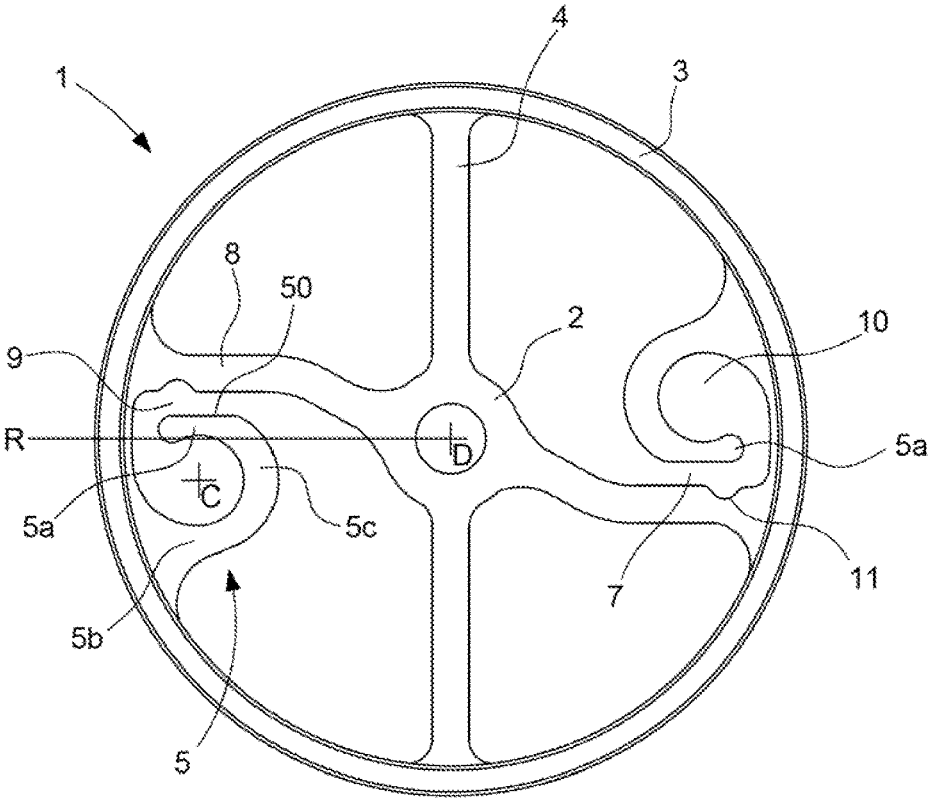
FIG. 1 is a top view of a balance in accordance with the invention according to a first embodiment.

A balance according to an exemplary embodiment will now be described in what follows with reference jointly to FIGS. 1, 2, 3, 4*a* and 4*b*.

The invention relates to a balance 1 for a horological movement. The balance comprising rigid parts consisting of a hub 2 whose centre defines the pivot axis A of the balance 1, a felloe 3, and at least one arm 4 connecting the felloe 3 to the hub 2.

Depending on the needs of the person skilled in the art, the balance is made of copper, or a copper alloy such as nickel silver. The balance wheel can also be made of aluminium, aluminium alloy, titanium or titanium alloy, gold or gold alloy, platinum or platinum alloy.

The balance 1 also comprises at least one elastic arm 5 comprising a first end 5B integral with the felloe of the balance 1, and a second distal end 5A free relative to the hub 2, to the arm 4, and to the felloe sector 3, the free end 5A being capable of being deformed in the plane of the felloe and clamp an inertia-block 6 on the balance. The balance also has a slot 7 capable of receiving the inertia-block 6, the slot 7 being delimited on the one hand by the free end 5A of the elastic arm, and on the other hand by a rigid part 8 integral with the felloe and the hub. The slot 7 has an opening 9 allowing the end 5A of the elastic arm to displace perpendicularly relative to the arm 4 and to be in contact with the inertia-block 6 in order to clamp it against the arm 4 when the latter is placed in the slot.

According to the invention, the elastic arm 5 comprises a hook-shaped body 5C, the free distal end 5A of the hook being parallel to a part of the balance which has a rigidity greater than or equal to that of the elastic arm 5, such a hook shape allows a good distribution of the stresses while limiting the congestion in the free space between the felloe and the hub.

In addition, such a geometry allows the bottom of the housing formed by the elastic arm 5, namely the inner surface S1, to be subjected to compression and no longer to tension as usual in the prior art. The main advantage of this is to compensate for the defects which may be formed such as microcracks, this area working in compression therefore it becomes less subject to these defects.

Figure 2:
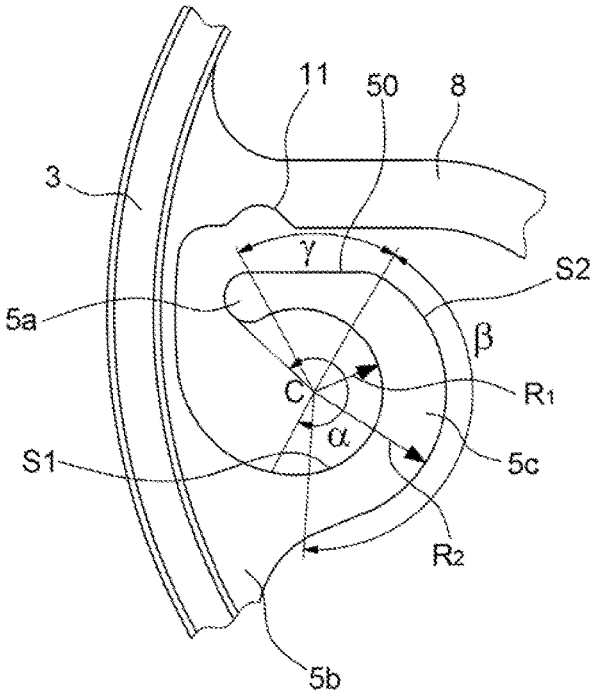
FIG. 2 is a top view of an elastic clamping organ of a balance in accordance with the invention according to a first embodiment.

As can be seen in FIG. 2, the free distal end 5A of the elastic arm 5 has a flat section 50 disposed opposite the part of the balance having a rigidity greater than or equal to that of the elastic arm 5, the rigid part can be an arm 4 of the balance or another elastic arm 5 for example.

It will be noted that the elastic arm 5 comprises an inner surface S1 of constant curvature over an angle $\alpha$, at the centre of the circle having a centre C, greater than 240°, such a configuration allowing the arm to work in compression along the inner surface S1.

The elastic arm 5 also comprises a constant section over an angle $\beta$, at the centre of the circle having a centre C, greater than 150°, such a configuration allowing more material to be under stress.

The flat section 50 extends over an angle $\gamma$, at the centre of the circle having a centre C, comprised between 20° and 50°.

Advantageously, the slot 7 extends parallel to a radial R from said pivot axis D, and opens into a housing 10 and comprises a notch 11 to precisely position the inertia-block 6 and retain it in place. The width of the opening 9 is provided less than the diameter of the inertia-block or of the rod of the inertia-block to retain the inertia-block in place.

The inertia-block 6 includes a head 61 including an adjustment profile 63 arranged to cooperate with a tool. The inertia-block 6 may comprise a rod 62 which extends this head 61, which has a diameter greater than that of the rod 62.

In the example illustrated in the figures, the inertia-block 6 is equipped with a foot 65, that the rod 62 then connects to the head 61, the latter and the foot 65 then both having a diameter greater than that of the rod 62, so as to limit the travel of the inertia-block 6 at the elastic arm 5, in a direction parallel to the pivot axis D, or even to immobilise it in this direction.

The rod 62 extends along an axis passing through the centre of the inertia-block 6, once gripped by the elastic arm 5, the inertia-block is angularly orientable around this axis by means of a tool on the adjustment profile 63. The inertia-block 6 includes an unbalance around this axis, which results for example from a flat section 64 made on the head 61, as can be seen in FIG. 2*a*.

When the inertia-block 6 is placed in the notch 11 of the opening 9, the free end 5A of the elastic arm 5 is displaced perpendicularly to the general direction of the radius connecting the attachment of the rigid arm to the hub and to the felloe relative to the rigid wall 8. The free end 5A has a flat face, opposite the notch 11, to provide a good retention for the rod of the inertia-block 6.

The inertia-block 6 comprises a rod 62 the minimum diameter of which is greater than the width of the slot 7 in the free state, and the maximum diameter of which is less than the width of the slot 7 when the elastic arm 5 is spread from the rigid part 8 of the balance 1 delimiting the slot 7 under the effect of a spreading force applied to the slot 7 or to the elastic arm 5.

According to the invention, the elastic arm 5 forms a housing 10 delimited by a wall 50, the body 5C of the elastic arm being arranged to elastically deform when the inertia-block 6 is assembled to the balance, the free end 5A of the elastic arm 5 being able to displace substantially perpendicularly, in the plane of the felloe, relative to the arm 4.

Figure 3:
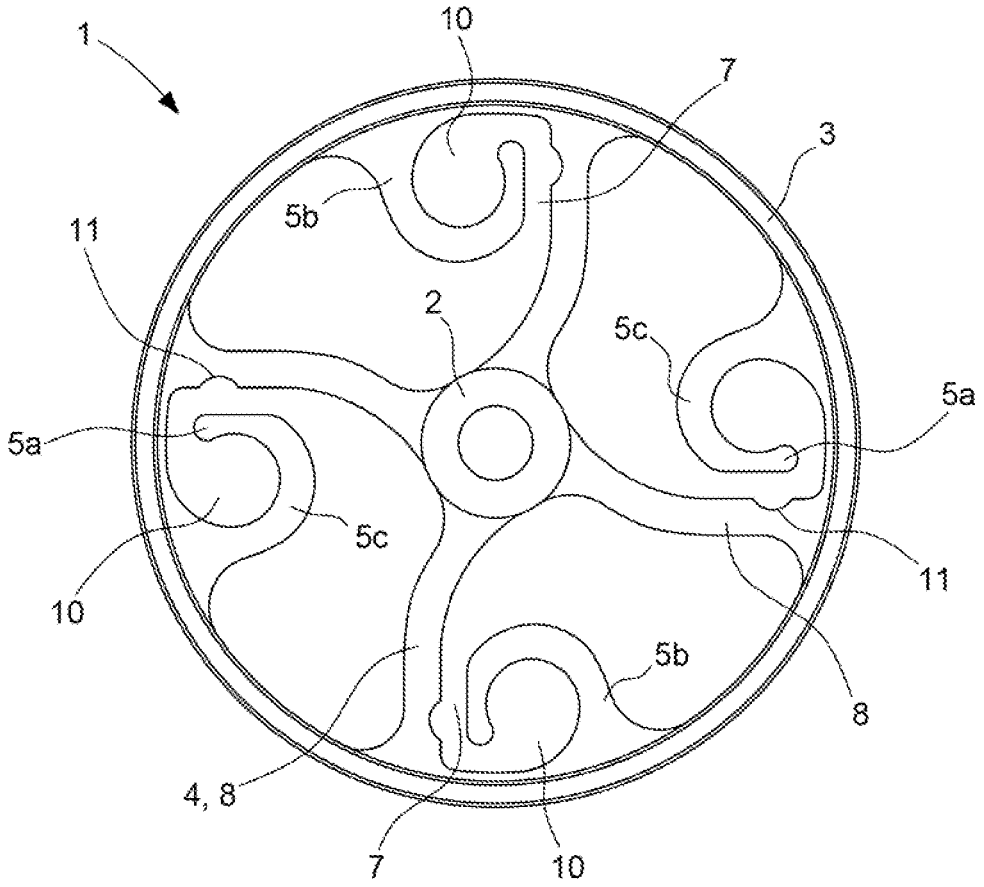
FIG. 3 is a top view of a balance in accordance with the invention according to a second embodiment.
Figure 4A:
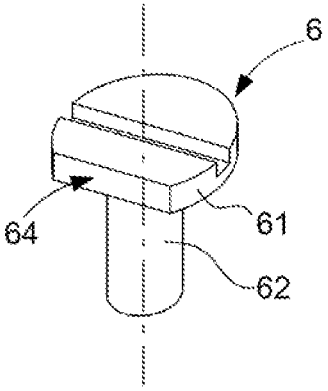
FIGS. 4*a* and 4*b* illustrate inertia-blocks that can equip a balance in accordance with the invention.
Figure 4B:
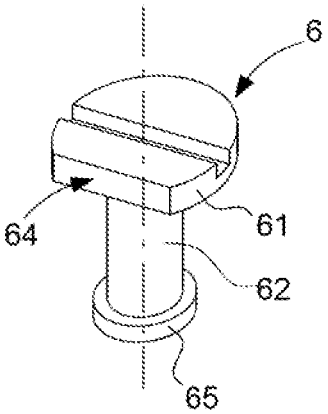

As shown in FIG. 3, the housing 10 has a circular shape having a centre C, of inner radius R1 and outer radius R2, the distance between the two radii R1 and R2 representing the thickness of the circular arc portion.

Advantageously, the body 5C of the elastic arm 5 has a first portion in the shape of an arc of a circle of constant section. The circular arc shape allows, on the one hand to increase the surface over which the stresses are distributed, and on the other hand to store as much elastic energy as possible thanks to a larger volume of material under stress than the prior art. The body 5C also comprises a second portion in the extension of the first portion, the second portion being parallel to said arm.

As can be seen in FIG. 2, the first portion of the arm has a greater thickness compared to the second portion. Such a configuration allows to have more material under stress and therefore to store more energy and thus restore a good holding force on the inertia-block 6. In the present case, the first circular arc-shaped portion only undergoes very little plastic deformations while providing a very good retention of the inertia-block.

The second portion of the arm, disposed parallel to the rigid part 8, has a lesser thickness compared to the first portion. The second portion of the elastic arm can be considered as an embedded beam of non-constant section subjected to bending, the body 5C therefore only undergoes very little plastic deformations.

According to the tests carried out by the inventors, the elastic arm 5 undergoes only 0.3% of plastic deformations along the wall of the circular arc portion, while the solution used in the prior art undergoes 2% of plastic deformations. Therefore, the solution used allows to reduce the stresses undergone by the elastic arm 5 when placing the inertia-block 6. Such a geometry allows to subject the inner wall of the circular arc portion of the elastic arm 5 to compression and the outer wall to tension. Such a configuration also allows to limit, or even eliminate, the formation of weakened areas such as microcracks that are harmful to the good retention of the inertia-block over time.

The dimensions and the geometry of the elastic arm 5 are determined to obtain a minimum desired force for holding the inertia-block, the retaining force obtained by the elastic arm being at least 0.7 N.

Likewise, the length and width of the circular arc portion of the elastic arm 5 are determined to remain below a stress level in order to avoid a plastic deformation. The dimensions of the elastic arm 5 allow to store a significant elastic energy resulting from the deformation of the arm, the deformation energy being restored in the form of a retaining force on the rod of the inertia-block clamped by the elastic arm 5, which ensures its force and torque holding in the notch 11.

It will also be noted that the housing 10 formed by the elastic arm 5 has a relatively large radius at the bottom of the curvature, this particular shape is determined to obtain a better distribution of the stresses during the assembly of the inertia-block 6, the stresses being distributed over a much larger surface compared to the prior art, this allows to avoid weakening the structure along the curvature formed by the arc of a circle. Indeed, in the prior art, the radius at the bottom of the curvature of the retaining organ is much smaller, which implies a very localised distribution of stresses, the formation of microcracks at this location, and therefore a gradual reduction in the retaining force over time.

The invention allows, through the particular geometry of the elastic arm 5, to obtain a satisfactory force for holding the inertia-block and to eliminate the formation of weakened areas when the arm is displaced to place the inertia-block 6. It appears that the amount of material under stress is determining to exert a satisfactory retaining force on the inertia-block (According to the formula of Clapeyron, the elastic energy stored in the material body is equal to the work of all the applied forces, $W=\frac{1}{2}\Sigma_i{}^n\vec{F}_i\Delta\vec{d}_i$).

The ideal solution would therefore be to increase the amount of material under stress as much as possible so that the elastic arm restores a greater retaining force. However, such an option implies a larger size of the elastic arms, which would significantly modify the inertia of the balance and complicate the mounting of the latter, in particular the pinning up to the stud.

According to the embodiments, illustrated in FIG. 1 and FIG. 3, the balance can comprise two or four elastic arms 5.

The invention also relates to a method for mounting an inertia-block on a balance as described above. The assembly method according to the invention comprises the following steps:

a) placing the balance 1 on a support and keeping it in place;

b) displacing the free end 5A of the elastic arm 5 perpendicularly in the plane of the felloe, relative to the arm 4;

c) placing the inertia-block 6 at the notch 11 so that the foot 65 coincides with the location of the notch 11;

d) displacing the inertia-block 6 in a rectilinear direction towards the notch 11 to house the foot 65 in the latter.

The method may comprise an optional step following step c) during which the inertia-block 6 is finely positioned so that the head of the inertia-block is in contact with the upper face of the arm 5 and the upper face of the rigid wall 8.

The invention also relates to a balance 1 which includes a plurality of retaining organs 5, each being arranged to receive at least one inertia-block 6.

The invention also relates to a horological movement including at least one such balance 1 as described above.

The invention also relates to a timepiece including at least one such movement, and which is preferably a watch.

The invention claimed is:

1. A balance for a horological movement, comprising rigid parts consisting of a hub defining the pivot axis of said balance, at least one felloe sector, at least one arm connecting said at least one felloe sector to said hub, and including at least one slot for receiving and gripping an inertia-block in position, said at least one slot opening into a housing delimited on the one hand by a rigid part of said balance, and on the other hand an elastic arm including a first end integral with the felloe of said balance, and a second distal end free relative to said hub, to said arm, and to said felloe sector, wherein said elastic arm comprises a hook-shaped body, the free distal end of the hook being parallel to a part of the balance having a rigidity greater than or equal to that of the elastic arm.

2. The balance according to claim 1, wherein the free distal end of the elastic arm has a flat section, the flat section being disposed opposite the part of the balance having a rigidity greater than or equal to that of the elastic arm.

3. The balance according to claim 1, wherein the elastic arm comprises an inner surface of constant curvature over an angle $\alpha$, at the centre of the circle having a centre C, greater than 240°.

4. The balance according to claim 1, wherein the elastic arm comprises a constant section over an angle $\beta$, at the centre of the circle having a centre C, greater than 150°.

5. The balance according to claim 2, wherein the flat section extends over an angle $\gamma$, at the centre of the circle having a centre C, comprised between 20° and 50°.

6. The balance according to claim 1, wherein the slot extends parallel to a radial from said pivot axis.

7. The balance according to claim 1, wherein the elastic arm is shaped to remain under a plastic deformation threshold of 0.3% at the bottom of the housing during a substantially vertical rise of the elastic arm relative to the arm of the balance when the rod of the inertia-block is placed.

8. The balance according to claim 1, wherein said housing is circular in shape having a centre C and a radius with an inlet defined by the slot and a bottom.

9. The balance according to claim 1, wherein the elastic arm provides a retaining force of at least 0.7 N when the inertia-block is mounted.

10. The balance according to claim 1, wherein said rigid part comprises a notch for positioning the inertia-block, the width of the opening being less than the diameter of the rod of the inertia-block.

11. The balance according to claim, wherein said at least one elastic arm is made in one piece with the balance.

12. The balance according to claim 1, further comprising a plurality of elastic arms, the elastic arms being disposed in a central symmetry having as centre that of the balance.

13. A horological movement including at least one balance according to claim 1.

14. A timepiece including at least one movement according to claim 13, wherein the timepiece is a watch.

15. A method for mounting an inertia-block on a balance according to claim 1, the mounting method comprising the following steps:

a) placing the balance on a support and keeping it in place;

b) placing the inertia-block at the housing so that the foot rests in the housing, the foot being positioned in line with the slot;

c) displacing the inertia-block in a rectilinear direction towards the slot to house the foot in the notch, the foot of the inertia-block spreading the elastic arm during its displacement.

* * * * *